US006357329B1

(12) United States Patent
Sakamoto et al.

(10) Patent No.: US 6,357,329 B1
(45) Date of Patent: Mar. 19, 2002

(54) TOOL CENTERING MECHANISM IN PUNCH PRESS

(75) Inventors: Hiroichi Sakamoto, Kagamihara; Koji Ozeki, Inuyama, both of (JP)

(73) Assignee: Murata Kikai Kabushiki Kaisha, Kyoto (JP)

( * ) Notice: Subject to any disclaimer, the term of this patent is extended or adjusted under 35 U.S.C. 154(b) by 0 days.

(21) Appl. No.: 09/517,320

(22) Filed: Mar. 2, 2000

(30) Foreign Application Priority Data

Mar. 4, 1999 (JP) ..... 11-056343
Mar. 4, 1999 (JP) ..... 11-056344

(51) Int. Cl.[7] ..... B26B 1/00

(52) U.S. Cl. ..... 83/698.91; 83/698.31; 83/556; 83/561

(58) Field of Search ..... 483/28, 29; 83/698.91, 83/699.31, 699.41, 698.11, 553, 559, 562, 561, 556, 698.51, 685, 698.31

(56) References Cited

U.S. PATENT DOCUMENTS 4,050,337 A * 9/1977 Allemand ..... 83/552
4,412,469 A * 11/1983 Hirata et al. ..... 83/552
4,485,549 A * 12/1984 Brolund ..... 83/698
4,552,050 A * 11/1985 Grefe ..... 83/685
5,048,385 A * 9/1991 Eckert et al. ..... 83/552
5,263,237 A * 11/1993 Gallant et al. ..... 83/552
5,346,454 A * 9/1994 Hayashi ..... 83/552
5,367,935 A * 11/1994 Matsuda ..... 83/552
5,471,901 A * 12/1995 Nishiya et al. ..... 83/556
5,499,566 A * 3/1996 Endo et al. ..... 83/636
5,669,866 A * 9/1997 Julian et al. ..... 483/29
5,810,704 A * 9/1998 Seto et al. ..... 483/1
6,109,159 A * 8/2000 Seto ..... 83/699.31

FOREIGN PATENT DOCUMENTS

JP 4-319026 11/1992
JP 7-185686 7/1995
JP 9-276957 10/1997

* cited by examiner

*Primary Examiner*—M. Rachuba
*Assistant Examiner*—Kim Ngoc Tran
(74) *Attorney, Agent, or Firm*—Armstrong, Westerman & Hattori, LLP

(57) ABSTRACT

The present invention provides a tool centering mechanism for a punch press having a plurality of tools installed in juxtaposition and which can simultaneously be replaced with new ones, wherein the tool pitch of the tools can be adjusted to agree with the pitch of cooperating tools. A tool holder (32) is provided on a first support (7), the tool holder (32) has a plurality of tool support sections (13,14) spaced at a predetermined pitch and which can each support a tool (9). The tool support sections (13,14) each allow a tool (10) cooperating with the tool (9) in punching to be installed on its axis. In a punch press of the above construction, the tool holder (32) and one (10B) of the cooperating tools (9) can be moved relative to the first support (7) and a second support (8), respectively. Simulated punching is carried out to move the tool holder (32) and the adjustable cooperating tool (10B) so that the cooperating tool (10B) can be installed on the axis of an associated one of the tools (9) on the first support (7).

6 Claims, 5 Drawing Sheets

TOOL CENTERING MECHANISM IN PUNCH PRESS

FIELD OF THE INVENTION

The present invention relates to a tool centering mechanism for use in various types of punch presses including turret types to center punch tools and die tools.

BACKGROUND OF THE INVENTION

In some conventional tool centering mechanisms for punch presses, a die holder base 74 on which a die holder 73 is installed is mounted with bolts 75 for alignment relative to a lower turret 71, as shown in FIG. 6. In a double track, such as one shown in FIG. 6, the common die holder 73 has die tools (not shown in the drawing) for an in-track Ti and an out-track To installed therein.

A centering operation is performed by inserting a centering punch 77 into a punch installation hole 76 in an upper turret 73 and fitting the centering punch 77 in a die installation hole 78 in the die holder 73. That is, the die holder 73 is aligned using processing in the upper turret 72 as a reference.

In a double-track turret punch press, the in-track Ti and the out-track To are simultaneously centered using the processing in the upper turret 72 as a reference.

Perfect centering, however, is impossible because a pitch P2 between the in-track and the out-track in the upper turret 71 is actually slightly different from a pitch P1 between the in-track and the out-track in the lower turret 72. In addition, the die holder 73 cannot be aligned and punch tools (not shown in the drawing) cannot be aligned relative to the upper turret 72. That is, aligning refers to the action for adjusting the direction of the cross section of non-circular punches and dies so as to be mutually aligned in a longitudinal or lateral direction of the machine, and this action is impossible.

SUMMARY OF THE INVENTION

It is an object of the present invention to provide a tool centering mechanism for a punch press having a plurality of tools provided in juxtaposition at a predetermined pitch and which can be simultaneously replaced with new ones, wherein the pitch of the tools can be adjusted to agree with the pitch of cooperating tools.

It is another object of the present invention to enable the cooperating tools to be locked after alignment using a simple construction and to enable various tools to be accommodated.

It is yet another object to facilitate tool replacement and a subsequent centering operation.

A tool centering mechanism for a punch press according to the present invention comprises a first support including a tool holder having a plurality of tool support sections spaced at a determined pitch and which can each support a tool, and a second support for allowing cooperating tools associated with the above tools in punching to be each installed on the axis of one of the plurality of tool support sections, and has the following features.

In this tool centering mechanism, the tool holder and one of the tools therein are provided for movement in a direction orthogonal with the axes of the first and second supports, respectively, and the tools in the second support and the cooperating tools in the first support are subjected to simulated punching to move the tool holder and the movable corresponding tool in the orthogonal direction in order to align the tool on the axis of the second support with an associated tool on the first support. The first and second supports may be different sites of an integral part.

According to this tool centering mechanism, the simulated punching causes the tool holder on the first support side to move slightly relative to the fixed corresponding tool in the second support for centering. The movable tool in the second support is moved slightly relative to the centered tool holder for centering. Thus, the pitch of the cooperating tools can be adjusted to agree with the pitch of the tools on the first support side. The simulated punching may be carried out twice. That is, during first simulated punching, the tool holder on the first support side is moved slightly relative to the fixed cooperating tool in the second support for centering to fix the tool holder to the first support. Subsequently, a second simulated punching is carried out to move the movable tool in the second support slightly relative to the centered fixed tool holder for centering.

The tools and cooperating tools used for the simulated punching may be those exclusively used for centering, that is, jigs exclusively used for centering in place of tools and cooperating tools used for actual processing.

According to the present invention, the movable cooperating tool may be installed for movement via a bush relative to the second support, and the bush may be fixed to the second support for alignment. The cooperating tool can be replaced using the bushes.

With this construction, the bush for supporting the cooperating tools is adjustably fixed to the second support, so that after adjustments to the second support, the cooperating tools can be locked suing a simple construction. In addition, since the cooperating tool can be replaced using the bush, the same tool centering mechanism can accommodate various tools.

If the bush is provided as described above, a clearance may be provided between the bush and the second support. With this clearance, in replacing the tools, the bush may be located in the second support at an approximate position before alignment, thereby facilitating tool replacement and a subsequent centering operation.

In addition, according to this tool centering mechanism, the corresponding tools are provided for independent movement in a direction orthogonal with the axis of the second support, and the tools and the corresponding tools are subjected to simulated punching to move the cooperating tools in the orthogonal direction in order to install each of the cooperating tools on the axis of a corresponding one of the tools on the first support. The first and second supports may be different sites of an integral part.

According to this tool centering mechanism, since the cooperating tools can be independently moved relative to the second support, each tool can be centered relative to a corresponding one of the tools on the first support during the simulated punching. Consequently, the pitch of the cooperating tools can be adjusted to agree with the pitch of the tools on the first support side.

The tools and cooperating tools used for the simulated punching may be those exclusively used for centering, that is, jigs exclusively used for centering in place of tools and cooperating tools used for actual processing.

In the present invention, the cooperating tools may be installed for movement via use of bushes in the second support, and the bushes may be fixed to the second support for alignment. The cooperating tools can be replaced using the bushes.

With this construction, the bush for supporting the cooperating tools is adjustably fixed to the second support, so that after adjustments to the second support, the cooperating tools can be locked using a simple construction. In addition, since the cooperating tool can be replaced using the bush, a tool centering mechanism of the same construction can accommodate various tools.

If the bushes are provided as described above, a clearance may be provided between the bush and the second support. With this clearance, in replacing the tools, the bushes may be located in the second support at approximate positions before alignment, thereby facilitating tool replacement and a subsequent centering operation.

DETAILED DESCRIPTION OF THE PREFERRED EMBODIMENTS

Figure 1:
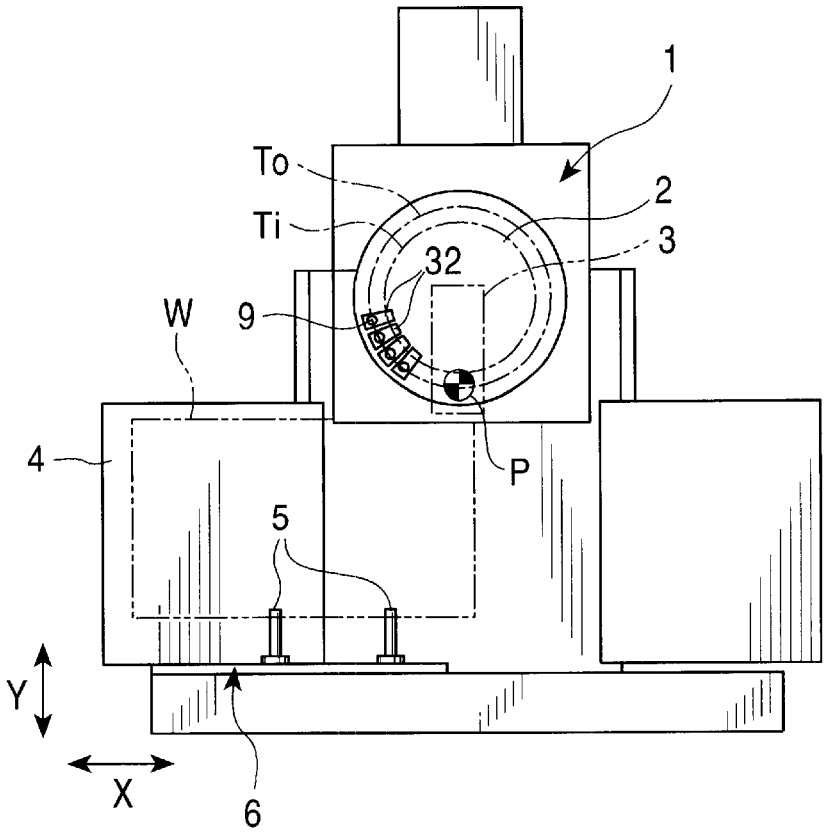
FIG. 1 is a partial schematic top view of a punch press including a tool centering mechanism according to one embodiment of the present invention.
Figure 2:
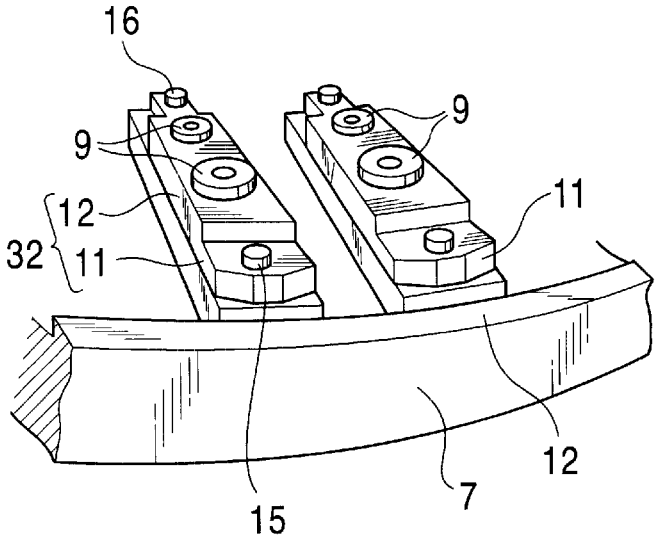
FIG. 2 is a fragmentary perspective view of a lower turret acting as a first support.

One embodiment of the present invention will be described with reference to FIGS. 1 to 4. This punch press is comprised of a machine body 1 having a tool support 2 installed thereon and a punch drive mechanism 3 also installed thereon for punching a punch tool installed on the tool support 2, and a work feeding mechanism 6 using a work holder 5 to grip and feed a work W of a plate on a table 4 to a predetermined punch position P.

Figure 3:
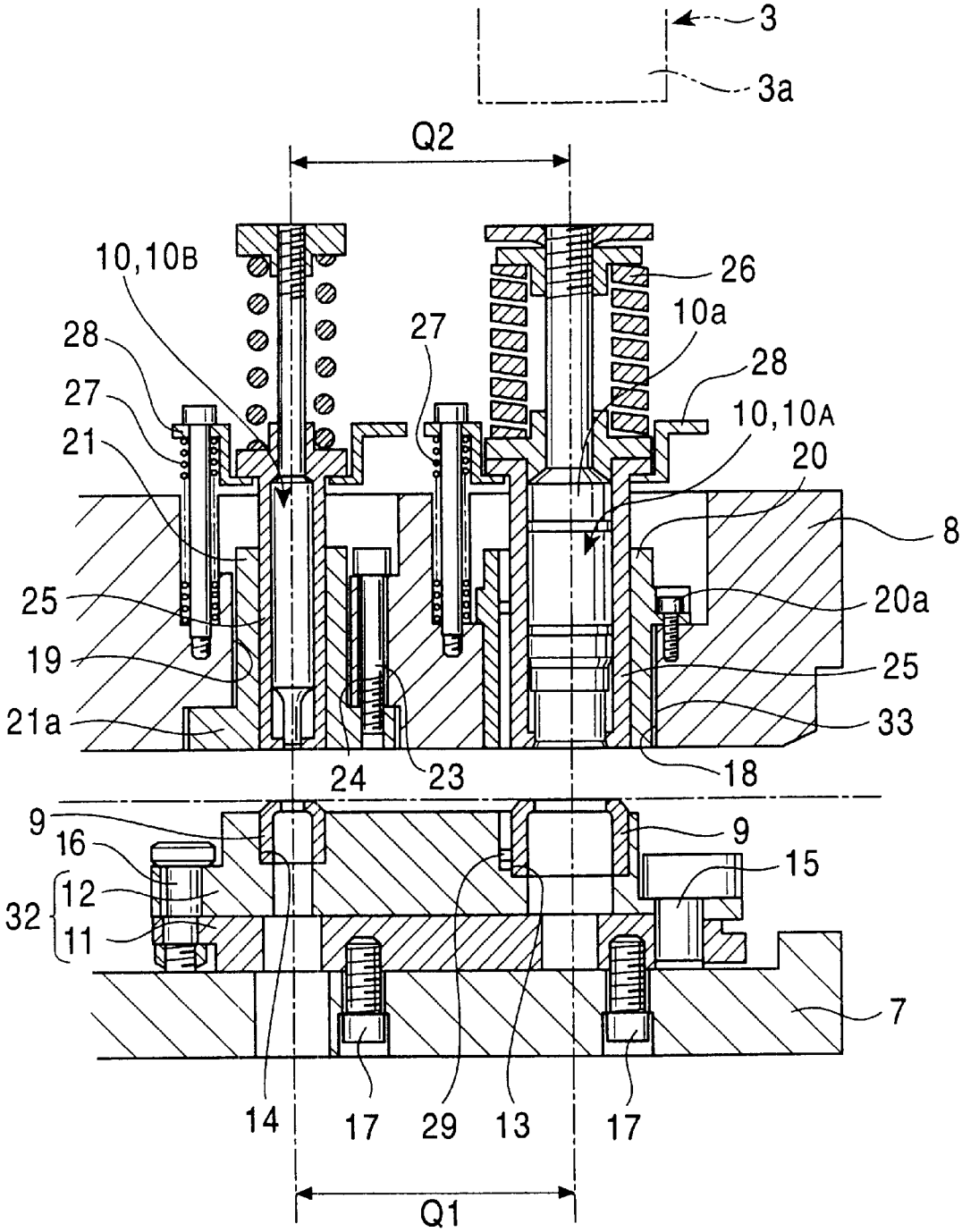
FIG. 3 is a sectional side view of the tool centering mechanism.

The tool support 2 is comprised of a first support 7 placed closer to the bottom of the punch press and a second support 8 placed closer to the top of the punch press, as shown in FIG. 3 in an enlarged view. The supports 7, 8 each comprise a turret and have tools 9 and tools 10 that cooperate with the tools 9, respectively, installed in a circumferential direction at a plurality of positions. The tool 9 comprises a die tool, while the cooperating tool 10 comprises a punch tool.

The first and second supports 7, 8 each have a plurality of tracks, for example, an out-track To and an in-track Ti (FIG. 1) around a rotational center axis in a manner such that the tools 9 and the cooperating tool 10 are installed on each of the tracks, To, Ti. Thus, predetermined pitches Q1, Q2 are set between the tools 9, 9 installed on the tracks To, Ti of the support 7 and between the cooperating tools 10, 10 installed on the tracks To, Ti of the support 8, respectively, so as to correspond to track intervals.

The tools 9 are installed on the first support 7 via a die holder base 11 and a die holder 12. The die holder base 11 and the die holder 12 are provided for each tool installation position in the circumferential direction of the support 7, and the tools 9 on the tracks To, Ti are installed on the common die holder 12. The die holder base 11 and die holder 12 constitute a tool holder 32.

The die holder 12 has tool support sections 13, 14 for installing the tools 9, that is, the die tools thereon, and the tool support sections 13, 14 are shaped like counterbores. The die holder 12 is removably mounted on the die holder base 11 via fixtures 15, 16 located at opposite ends. The fixtures 15, 16 each comprise a pin or a bolt. For example, the fixture 16 at the inner end extends through the die holder base 11 in a vertical direction to engage with a mounting groove in the die holder 12. In addition, the fixture 15 is inserted through positioning holes in the die holder base 11 and die holder 12. The die holder base 11 is placed on the support 7 and locked from its bottom surface using bolts 17 that are received in threaded holes in the die holder base. An unthreaded bolt insertion hole in the first support 7 through which the bolt 17 is inserted has an inner diameter smaller than the diameter of the bolt head to provide a very small clearance between the internal hole surface and the bolt so that the die holder base 11 can have its position finely adjusted relative to the support 7. The die holder 12, the die holder base 11, and the support 7 each have scrap drop holes in communication with the tool support sections 13, 14.

In installing the cooperating tools 10 in the second support 8, one of the plurality of cooperating tools, indicated as 10A, and provided at a common support indexing position is installed as a reference so that it cannot be aligned relative to the second support 8, whereas the other cooperating tool 10B is installed for movement in a direction orthogonal with the axis of the second support 8. In this example, the cooperating tool on the out-track To side is the reference cooperating tool 10A, while the cooperating tool on the in-track Ti side is the movable, that is the adjustable cooperating tool 10B. In addition, if the reference cooperating tool 10A and the adjustable cooperating tool 10B have different sizes, the reference cooperating 10A has a larger size.

Specifically, the cooperating tools 10 are installed via bushes 20, 21 in cooperating tool support sections 18, 19 provided in the tracks To, Ti of the second support 8, respectively. The cooperating tool support sections 18, 19 are each a hole formed in the support 8 in a fashion penetrating it in a vertical direction. The bushes 20, 21 are installed in the corresponding tool support sections 18, 19, respectively, comprising through-holes.

The bush 21 for the adjustable cooperating tool 10B is installed in the cooperating tool support section 19 via a very small clearance. In addition, the adjustable cooperating tool support section 19 has a counterbore section opened in the bottom surface of the second support 8, and the bush 21 has a flange section 21*a* fitted in the counterbore section. The flange section 21*a* has a tapped hole and is tightened and fixed to the second support 8 using a fixation bolt 23. The fixation bolt 23 is inserted into a fixation hole 24 penetrating the counterbore in the cooperating tool support section 19 from the top surface of the second support 8. The fixation hole 24 is formed to have an inner diameter sized to form a very small clearance around the fixation bolt 23.

The bush 20 for the reference cooperating tool 10A is installed in the cooperating tool support section 18 in such a manner as to form almost no clearance. In addition, the bush 20 on the reference side is fixed to the top surface of the second support 8 using a flange section 20*a* provided at its upper end and a bolt 33. The reference cooperating tool 10A may be directly installed in the corresponding tool support section 8 without the use of the bush 20.

Each cooperating tool 10 is comprised of a tool body 10*a* installed in a sleeve 25 for elevation, which is internally fitted in the bush 20, 21 for elevation. The sleeve 25 acts as a stripper for removing the tool body 10*a* from the work W.

The tool body 10*a* is urged against the sleeve 25 for elevation by means of a return spring 26 interposed between a head section of the tool body and the upper end of the sleeve 25. In addition, the cooperating tool 10 is entirely urged against the second support 8 for elevation by means of a retention spring 27. The retention spring 27 is provided in the outer periphery of a pin extending through the second support 8 in a vertical direction and engages with a flange member 28 engaged with the sleeve 25. Thus, after punching by a ram 3*a* of a punch drive mechanism 3, when the ram 3*a* elevates, the cooperating tools 10 are elevated to return to their original positions due to the urging force of the springs 26, 27.

Those of the tools 9 and the cooperating tools 10 which have a non-circular processing shape have rotational-position regulating means 29,30, respectively, provided around the axis of the tool. In this example, only the tools 9 and corresponding tools 10 on the out-track To side have the rotational-position regulating means 29, 30. The rotational-position regulating means 29 for the tool 9 comprises a projection or key provided on an outer-diameter surface of the tool 9 and key groove formed in the die holder 12 for allowing the projection of key to be fitted therein. The rotational-position regulating means 30 for the cooperating tool 10 comprises the projection or key provided for the cooperative tool 10 and the key groove formed in the bush 20 for allowing the projection or key to be fitted therein. Specifically, the projection or key is provided in the sleeve 25.

A tool centering function and a centering operation based on the above construction will be explained. In brief, after replacement of the tools 9 and the cooperating tools 10, the tool holder 32 is centered relative to the reference cooperating tool 10A (on the out-track To side) in the second support 8, while the reference cooperating tool 10A and the tool holder 32 are aligned using the machine body 1 as a reference. Next, the fixed tool holder 32 is used as a reference to center and align the movable cooperating tool 10B (on the in-track Ti side).

This operation will sequentially be explained. After replacement of the tools 9 and the cooperating tools 10, first, simulated punching is carried out to center the tool holder 32, that is, the die holder 12, relative to the reference cooperating tool 10A in the second support 8. After the centering operation, the die holder base 11 is fixed to the support 7 using the bolts 17. Simulated punching is executed by inserting the reference cooperating tool 10A supported in the second support 8 into the tool 9 on the first support 7. This simulated punching is carried out after the bolt 17, which is fixing the tool holder 32 to the first support 7, has been loosened. During this simulated punching, the tool holder 32 and the reference cooperating tool 10A are aligned. This alignment refers to the action for adjusting the direction of the cross section of the tool 9 with a non-circular processing section 9*a* so as to be parallel with a longitudinal (Y direction) or lateral (X direction) direction of the machine, as shown in FIG. 3. This operation can be achieved by fine-adjusting the direction of the die holder 12 relative to the support 7. The cooperating tool 10A is aligned with the tool 9 by adjusting the position of the bush 20 relative to the second support 8 and then locking the bush 20 with the bolt 22.

Next, using the adjusted die holder 12 as a reference, a second simulated punching is executed to center the adjustable corresponding tool 10B. This simulated punching is carried out by fitting the adjustable cooperating tool 10B in the associated tool 9 on the die holder 12 without operating the reference cooperating tool 10A. After centering, the bush 21 of the corresponding tool 10B is fixed to the second support 8 suing the bolt 23.

According to the tool centering mechanism of the above construction, the die holder 12 or the tool holder 32 is centered and then the adjustable cooperating tool 10B in the second support 8 is centered relative to the centered and fixed tool holder 32 as described above, thereby enabling theoretically perfect centering such that the pitch Q2 of the cooperating tool 10 agrees with the tool pitch Q1 on the first support 7 side.

Besides, a low rigidity of the bush 20 poses no problem because the reference cooperating tool 10A can be installed in the cooperating tool support section 18 in the second support 8 without a clearance. Accordingly, this construction is advantageous for the layout design of various tools. In addition, since large cooperating tools require a higher rigidity than smaller cooperating tools, a substantial decrease in rigidity can be prevented if the reference cooperating tool 10A is larger than the adjustable cooperating tool 10B.

Furthermore, in this embodiment, the adjustable cooperating tool 10B is adjustably fixed to the second support 8 via the bush 21 and can thus be locked for alignment, using a simple construction, compared to the direct installation of the cooperating tool 10B in the second support 8 for alignment. In addition, since the cooperating tools 10A, 10B can be replaced using the bushes 20, 21, respectively, the tool centering mechanism of the same construction can accommodate various cooperating tools 10.

Figure 5:
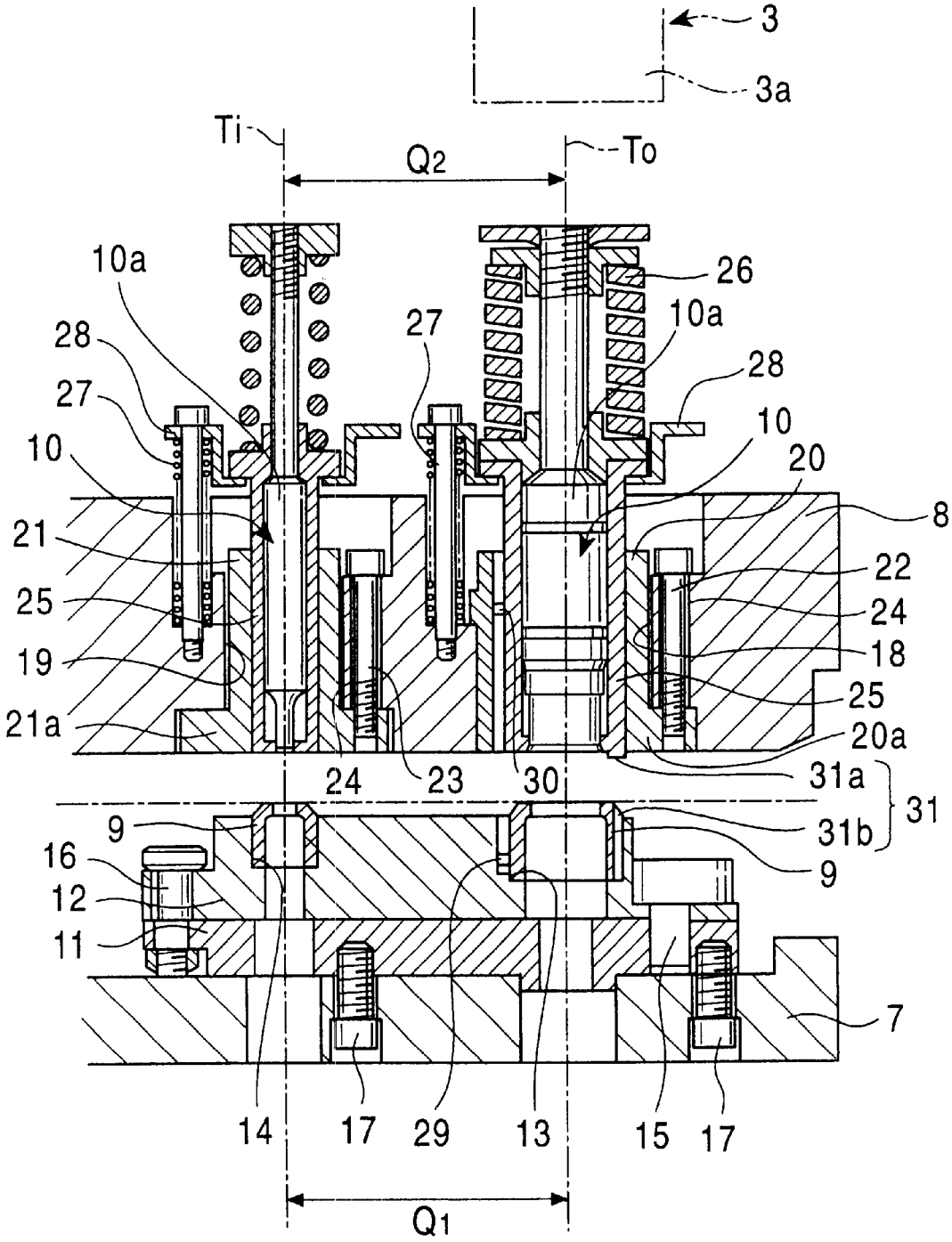
FIG. 5 is a sectional view of another embodiment of the present invention.
Figure 6:
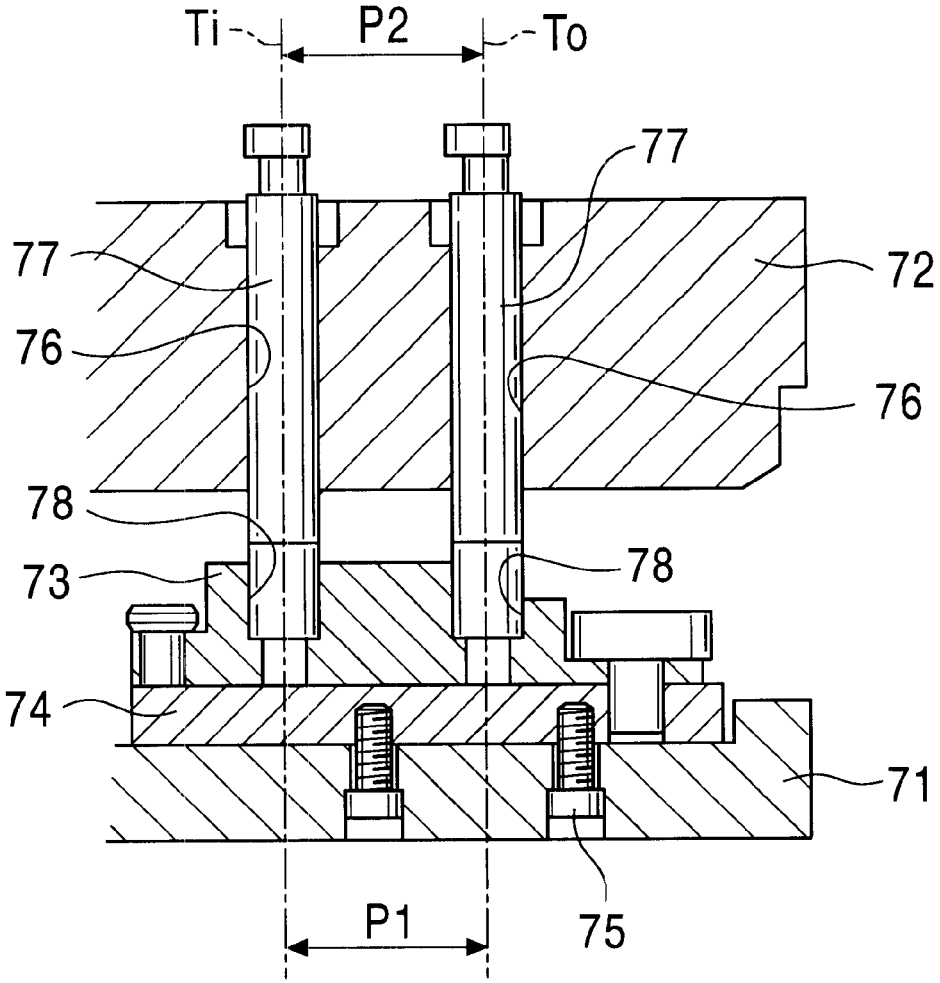
FIG. 6 PRIOR ART
FIG. 6 is a sectional view of a conventional example.

Next, another embodiment of the present invention will be shown in FIG. 5.

The tool support 2 is comprised of a first support 7 placed closer to the bottom of the punch press and a second support 8 placed closer to the top of the punch press, as shown in FIG. 5 in an enlarged view. The supports 7, 8 each comprise a turret and have tools 9 and tools 10 cooperating with the tools 9, respectively, installed in a circumferential direction at a plurality of positions. The tool 9 comprises a die tool, while the cooperating tool 10 comprises a punch tool.

The first and second supports 7, 8 each have a plurality of tracks, for example, an out-track To and an in-track Ti (FIG. 1) around a rotational center axis in a manner such that the tool 9 and the cooperating tool 10 are installed on each of the tracks To, Ti. Thus, predetermined pitches Q1,Q2 are set between the tools 9, 9 installed on the tracks To, Ti of the support 7 and between the tools 10, 10 installed on the tracks To, Ti of the support 8, respectively, so as to correspond to track intervals.

The tools 9 are installed on the first support 7 via the die holder base 11 and the die holder 12. The die holder base 11 and the die holder 12 are provided for each tool installation position in the circumferential direction of the support 7, and the tools 9 on the tracks To, Ti are installed on the common die holder 12.

The die holder 12 has tool support sections 13, 14 for installing the tools 9, that is, the die tools thereon, and the tool support sections 13, 14 are shaped like counterbores. The die holder 12 is movably mounted on the die holder base 11 via fixtures 15, 16 located at opposite ends. The fixtures 15, 16 each comprise a pin or bolt. For example, the fixture 16 at the inner end extends through the die holder base 11 in a vertical direction to engage with a mounting groove in the die holder 12. In addition, the fixture 15 is inserted through positioning holes in the die holder base 11 and die holder 12. The die holder base 11 is placed on the support 7 and locked form its bottom surface using a bolt 17. A bolt insertion hole in the first support 7 through which the bolt 17 is inserted has an inner diameter smaller than the bolt diameter to provide a very small clearance between the internal hole surface and the bolt so that the die holder base 11 can have its position finely adjusted relative to the support 7. The die holder 12, the die holder base 11, and the support 7 each have scrap drop holes in communication with the tool support sections 13, 14.

The cooperating tools 10 are installed in the second support 8 so that the individual cooperating tools 10 can be independently moved in a direction orthogonal with the axis of the second support 8. Specifically, the cooperating tools 10 are installed via the bushes 20, 21 in the cooperating tool support sections 18, 19 provided in the tracks To, Ti of the second support 8, respectively. The cooperating tool support sections 18, 19 are holes formed in the support 8 in a fashion penetrating it in a vertical direction. The bushes 20, 21 are installed in the cooperating tool support sections 18, 19 respectively, comprising through-holes, in a manner such as to form a very small clearance between the bush and the cooperating tool support section. The cooperating tool support sections 18, 19 each have a counterbore section opened in the bottom surface of the second support 8, and the bushes 20, 21 have flange sections 20*a* 21*a*, respectively, fitted in the counterbore section. The flange sections 20*a*, 21*a* each have a tapped hole and are tightened and fixed to the second support 8 using fixation bolts 22, 23, respectively. The fixation bolts 22, 23 are inserted into fixation holes 24, 24 penetrating the counterbores in the corresponding tool support section 18, 19, respectively, from the top surface of the second support 8. The fixation holes 24 are formed to have an inner diameter sized to form a very small clearance around the fixation bolts 22, 23.

Each cooperating tool 10 is comprised of a tool body 10 installed in a sleeve 25 for elevation, which is internally fitted in the bush 20, 21 for elevation. The sleeve 25 acts as a stripper for removing the tool body from the work W. The tool body 10*a* is urged against the sleeve 25 for elevation by means of a return spring 26 interposed between a head section of the tool body and the upper end of the sleeve 25. In addition, the cooperating tool 10 is entirely urged against the second support 8 for the elevation by means of a retention spring 27. The retention spring 27 is provided in the outer periphery of a pin extending through the second support 8 in a vertical direction and engaging with a flange member 28 engaged with the sleeve 25. Thus, after punching by a ram 3*a* of a punch drive mechanism 3, when the ram 3*a* elevates, the cooperating tools 10 are elevated to return to their original positions due to the urging force of the springs 26, 27.

Those of the tools 9 and cooperating tools 10 which have a non-circular processing shape have rotational-position regulating means 29, 30, respectively, provided around the axis of the tool. In this example, only the tools 9 and cooperating tools 10 on the out-track To side have the rotational-position regulating means 29, 30. The rotational-position regulating means 29 for the tool 9 comprises a projection or key provided on an outer-diameter surface of the tool 9 and a key groove formed in the die holder 12 for allowing the projection or key to be fitted therein. The rotational-position regulating means 30 for the corresponding tools 10 comprises a projection or key provided for the cooperating tools 10 and the key groove formed in the bush 20 for allowing the projection or key to be fitted therein. Specifically, the projection or key is provided on the sleeve 25.

In addition, rotational-position adjustment means 31 is provided which aligns the rotational positions of the tool 9 and the corresponding tool 10 around the corresponding tool axis. The rotational-position adjustment means 31 is comprised of a projection 31*a* and a recess 31*b* formed in the tool 9 and the cooperating tool 9, respectively, and meshing with each other.

A tool centering function and a centering operation based on the above construction will be explained.

Figure 4:
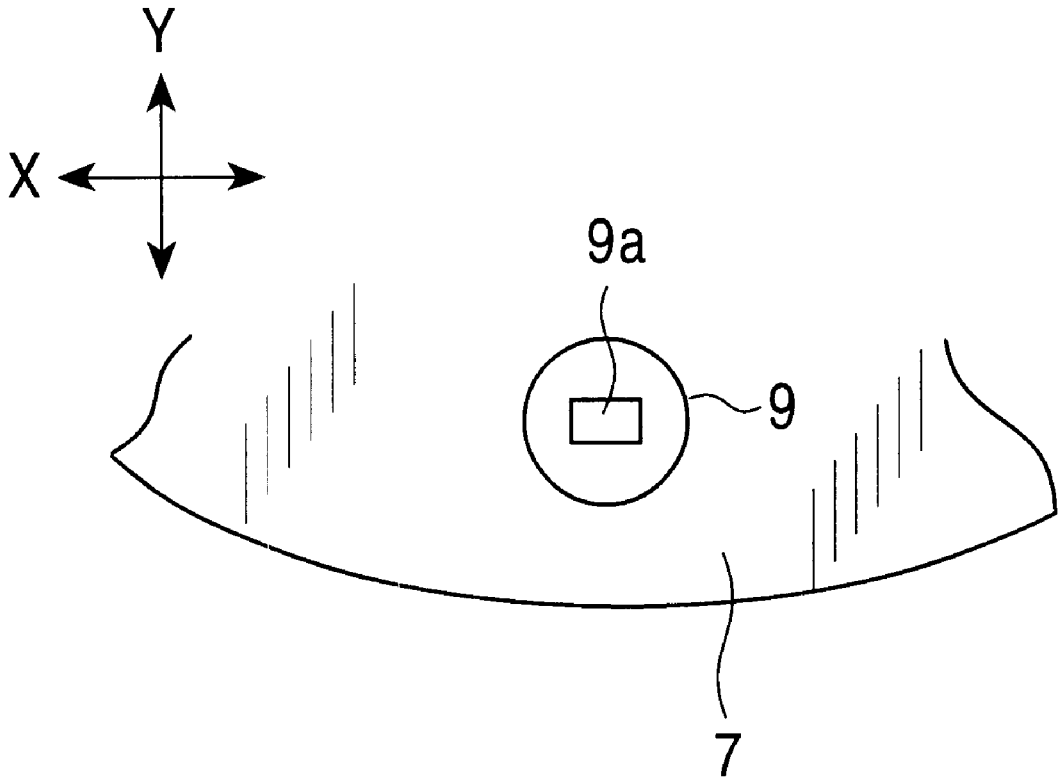
FIG. 4 is an explanatory drawing of an alignment operation performed by the tool centering mechanism.

After replacement of the tools 9 and the cooperating tools 10, the tools 9 are centered relative to the first support 7. The tools 9 are centered by centering the die holder 12. Simultaneously with this centering, the die holder 12 is aligned using the machine body 1 as a reference. Centering of the die holder 12 is an operation for adjusting the surface positions of the tool support sections 13, 14 of the die holder 12, and is achieved by adjusting the position of the die holder base 11 using appropriate measuring instruments or jigs. After the centering operation, the die holder base 11 is fixed to the support 7 using the bolts 17. Aligning refers to the action for adjusting the direction of the cross section of the tool 9 with a non-circular processing section 9*a* so as to be parallel with a longitudinal (Y direction) or lateral (X direction) direction of the machine, as shown in FIG. 4. This operation can be achieved by finely adjusting the direction of the die holder 12 relative to the support 7.

Next, using the adjusted die holder 12 as a reference, each cooperating tool 10 is centered and aligned relative to the second support 8. This center and aligning is carried out by subjecting the cooperating tool 10 support in the second support 8 is meshed with the tool 9 on the first support 7.

This meshing is executed while the bolts 22, 23 for locking the bushes 20, 21 are loosened. Then, together with the cooperating tools 10, the bushes 20, 21 freely move to positions at which they are concentric with the tools 9 relative to the second support 8. In addition, the projection 31 a of the rotational-position adjustment means 31 meshes with the recess 31*b* thereof, and the cooperating tools 10 are aligned relative to the machine body 1 so as to have the same rotational axes as the tools 9. Subsequently, the bolts 22, 23 are tightened at the adjusted positions to fix the bushes 20, 21 to the second support 8.

According to the tool centering mechanism of this construction, each cooperating tool 10 can be moved in the direction orthogonal with respect to the axis of the second support 8, and simulated punching is executed using the tools 9 on the first support 7 as a reference to individually center the corresponding tools 10 relative to the tools 9, as described above. Consequently, theoretically perfect centering is enabled to allow the pitch Q2 of the corresponding tools 10 to conform with the tool pitch Q1 on the first support 7 side. At the same time, the cooperating tools 10 can be perfectly aligned. In this example, only the cooperating tools 10 on the out-track side are aligned.

In addition, if re-centering is required due to thermal conversion, or the like, the above centering operation can be performed by loosening the bolts 22, 23 from a position above the second support 8 located closer to the top of the punch press, performing a simulated punching operation, and then tightening the bolts 22, 23. In this case, for turret punch presses, the operation is easier due to an excess processing space above the upper turret.

Furthermore, in this embodiment, the bushes 20, 21 for supporting the cooperating tools 10 are adjustably fixed to the second support 8, whereby the cooperating tools 10 can be locked for alignment, using a simple construction, compared to the direct installation of the cooperating tools 10 in the second support 8 for alignment. In addition, since the cooperating tools 10 can be replaced using the bushes 20, 21 a tool centering mechanism of the same construction can accommodate various cooperating tools 10.

Although in the above embodiment, the lower support has been referred to as the first support, but the upper support may be defined as the first support. In addition, the present invention is not limited to turret punch presses, that is, those punch presses which include the supports 7, 8 comprised of turrets, but is applicable to those punch presses which include the first and second supports 7, 8 comprising, for example, cartridges. In the case of the cartridge type, the first and second supports 7, 8 may be different sites of an integral tool support, such as upper and lower parts of an integral tool support.

In a punch press comprising a first support including a tool holder having a plurality of tool support sections, spaced at a determined pitch and which can each support a tool, the plurality of tool support sections each enabling a tool to be installed on its axis, the tool centering mechanism for a punch press according to the present invention is adapted so that the tool holder and one of the cooperating tools are movably provided so that simulated punching is carried out to move the tool holder and the movable cooperating tool in order to install each cooperating tool on the axis of the tool on the first tool support. Thus, the plurality of tools can be installed in juxtaposition at the predetermined pitch and can be simultaneously placed with new ones, the pitch of these tools can be adjusted to agree with the pitch of the cooperating tools. In addition, since only one of the plurality of cooperating tools can be moved, this construction can minimize a decrease in rigidity associated with movability of the cooperating tools relative to the second support.

If the movable cooperating tool is installed for movement via a bush relative to the second support, the bush is fixed to the second support for alignment, and the cooperating tools can be replaced using the bushes, then the cooperating tools can be locked after alignment using a simple construction, and this mechanism can minimize a decrease in rigidity and accommodate various tools.

If a clearance is formed between the bush and the second support, then the bushes can be placed at approximate positions to facilitate tool replacement and a subsequent centering operation.

In addition, the present invention provides a tool centering mechanism for a punch press comprising a first support having a plurality of tool support sections spaced at a determined pitch and which can each support a tool, the plurality of tool support sections enabling tools cooperating with the tools in punching to be each installed on its axis, wherein the cooperating tools are provided for independent movement in a direction orthogonal with the axis of the second support, and wherein the tools and the cooperating tools are subjected to simulated punching to move each cooperating tool in the orthogonal direction in order to install each cooperating tool on the axis of an associated one of the tools on the first support. Thus, the plurality of tools can be installed in juxtaposition at the predetermined pitch and can simultaneously be replaced with new ones, the pitch of these tools can be adjusted to agree with the pitch of the cooperating tools.

If the cooperating tools are installed for movement via bushes relative to the second support, the bushes are fixed to the second support for alignment, and the cooperating tools can be replaced using the bushes, then the cooperating tools can be locked after alignment using a simple construction, and this mechanism can accommodate various tools.

If a clearance is formed between the bush and the second support, then the bushes can be placed at approximate positions to facilitate tool replacement and a subsequent centering operation.

What is claimed is:

1. A tool centering mechanism for a punch press comprising a first support including a tool holder having a plurality of tool support sections spaced at a determined pitch along an axis of said first support and which can each support a tool, and a second support having an axis parallel to the axis of said first support for allowing cooperating tools associated with said tools in punching to be each installed on the axis of a corresponding one of said plurality of tool support sections, wherein said tool holder and one of said cooperating tools are mounted for movement in a direction orthogonal with respect to the axes of the first and second supports, respectively, to establish a reference position and in that said tools and said cooperating tools are subjected to simulated punching to move said tool holder and said movable cooperating tool in said orthogonal direction in order to install the cooperating tool on the axis of an associated one of the tools on the first support whereby said cooperating tools are inserted into said tools to be fixed and centered in a lateral direction in which they can be used for punching.

2. A tool centering mechanism for a punch press as in claim 1, wherein said movable cooperating tool is installed for movement via a bush relative to the second support, in that the bush is fixed to the second support for alignment, and in that the cooperating tool can be replaced using the bush.

3. A tool centering mechanism for a punch press as in claim 2, wherein a clearance is provided between said bush and said second support.

4. A tool centering mechanism for a punch press comprising a first support having a plurality of tool support sections spaced at a determined pitch and which can each support a tool, and a second support for allowing cooperating tools associated with said tools in punching to be each installed on the axis of an associated one of said plurality of tool support sections, wherein said cooperating tools are mounted for independent movement in a direction orthogonal with the axis of the second support, and in that said tools and said cooperating tools are subjected to simulated punching to move said cooperating tools in said orthogonal direction in order to install each of the coopering tools on the axis of associated ones of the tools on the first support whereby said cooperating tools are inserted into said tools to be fixed and centered in a lateral direction in which they can be used for punching.

5. A tool centering mechanism for a punch press as in claim 4, wherein said cooperating tools are installed for movement via bushes relative to the second support, in that the bushes are fixed to the second support for alignment, and in that the cooperating tools can be replaced using the bushes.

6. A tool centering mechanism for a punch press as in claim 5, wherein a clearance is provided between said bush and said second support.

* * * * *